US005269028A

United States Patent [19]

Liao

[11] Patent Number: 5,269,028

[45] Date of Patent: Dec. 14, 1993

[54] AUTOMATIC FLUSHING APPARATUS FOR URINALS

[76] Inventor: Su-Lan Liao, Room 2, 5F, No. 3, Lane 198, Chung-Hsing Rd., Feng-Yuan City, Taichung Hsien, Taiwan

[21] Appl. No.: 956,956

[22] Filed: Oct. 5, 1992

[51] Int. Cl.[5] ..... E03D 9/03; E03D 9/02

[52] U.S. Cl. ..... 4/313; 4/222; 4/226.1; 4/305; 4/302

[58] Field of Search ..... 4/302, 303, 304, 305, 4/307, 313, 222, 226.1

[56] References Cited

U.S. PATENT DOCUMENTS

| | | | |
|---|---|---|---|
| 853,434 | 5/1907 | Blackmore | 4/222 |
| 4,793,588 | 12/1988 | Laverty, Jr. | 4/302 |
| 5,027,444 | 7/1991 | Tsols | 4/226.1 |

FOREIGN PATENT DOCUMENTS

| | | | |
|---|---|---|---|
| 1028102 | 3/1978 | Canada | 4/222 |
| 356599 | 3/1990 | European Pat. Off. | 4/305 |
| 4174143 | 6/1992 | Japan | 4/302 |

*Primary Examiner*—Henry J. Recla
*Assistant Examiner*—Charles R. Eloshway
*Attorney, Agent, or Firm*—Arnold, White & Durkee

[57] ABSTRACT

An automatic flushing apparatus includes an electromagnetic valve, an electrical controlling apparatus in conjunction with the electromagnetic valve for effecting an automatic flushing operation. A first closed tank communicates to the outlet tube of the electromagnetic valve. An upright cylindrical tank is connected to the first closed tank and has a tube member extending inwardly from a central opening at the top end of the cylindrical tank. A piston member is slidably received in the tube member and is biased by a coil spring. A second closed tank contains an antiseptic solution and communicates to the tube member of the cylindrical tank by means of a connecting pipe. The connecting pipe has a branch pipe with an elastic rubber nipple member connected to the first closed tank. A check valve assembly is provided in the connecting pipe, which permits the antiseptic solution to flow from the second closed tank into the connecting pipe when the piston member is moved downward. The antiseptic solution in the connecting pipe is squeezed into the first closed tank through the nipple member when the piston member is forced upward against the biasing force of the coil spring.

2 Claims, 7 Drawing Sheets

AUTOMATIC FLUSHING APPARATUS FOR URINALS

BACKGROUND OF THE INVENTION

1. Field of the Invention

This invention relates to an automatic flushing apparatus for urinals, more particularly to an automatic flushing apparatus for urinals which has an antiseptic solution provided therein, the antiseptic solution being flushed on the urinals for sterilizing purposes after water flushes the urinals.

2. Description of the Related Art

At present, conventional automatic flushing apparatus for man's stall urinal is provided with a photoelectric sensing means to effect the automatic flushing operation. The automatic flushing apparatus pre-washes the urinal with a little amount of water when a user stand in front of it and is detected by the photoelectric sensing means. The automatic flushing apparatus flushes a large amount of water to wash the urinals after the user leaves the urinals. An antiseptic solution is then flushed out from the automatic flushing apparatus for sterilizing purposes. The antiseptic solution is contained in a tank and is withdrawn by means of an electric motor. Therefore, such a conventional automatic flushing apparatus has high power consumption.

SUMMARY OF THE INVENTION

It is therefore a main object of this invention to provide an automatic flushing apparatus for urinals in which the antiseptic solution is withdrawn using mechanical power to save on electric power.

Accordingly, the automatic flushing apparatus of this invention comprises:

a housing fixed on the top of the urinal;

an electromagnetic valve fixed in the housing, the electromagnetic valve having an inlet tube connected to a water pipe and an outlet tube connected to the urinal, the outlet tube having an inner tube coaxially mounted therein, the inner tube having an upper end which has an outwardly extending radial flange connected to an internal wall of the outlet tube, thereby defining a shoulder in the outlet tube;

a control means for opening and closing the electromagnetic valve;

a photoelectric emitting means for generating a light beam therefrom;

a photoelectric sensing means in connection with the control means and the photoelectric emitting means for automatically effecting water flushing operation;

a first closed tank having a top and a bottom, the bottom of the first closed tank having a first pipe connected to the outlet tube of the electromagnetic valve above the shoulder of the outlet tube, so that part of the flushing water can flow into and fill the first closed tank during the water flushing operation, and a second pipe having an upper end connected to the bottom of the first closed tank and a lower end connected to the outlet tube of the electromagnetic valve, which faces an external wall of the inner tube below the shoulder so as to prevent the flushing water from entering the second pipe;

a tubular member disposed in the first closed tank and having an open lower end connected to the upper end of the second pipe and a closed upper end extending near the top of the first closed tank, the closed upper end of the tubular member having a vent hole formed therein;

an upright cylindrical tank having a closed top and bottom end and being fixed in the housing beside the first closed tank, the bottom end having a third pipe connected to the bottom of the first closed tank, the top end of the cylindrical tank having a central opening formed therein and a tube member coaxially depending therefrom, the tube member having an upper open end connected to the central opening and a lower open end extending to an intermediate portion of the cylindrical tank, a first piston member being slidably received in the tube member and a second piston member being slidably received in a lower portion of the cylindrical tank, a connecting rod interconnecting the first and second piston members, a coil spring sleeved around the tube member and disposed between the top end of the cylindrical tank and the second piston member so as to urge the second piston member toward the bottom end of the cylindrical tank, a variable closed air chamber being confined between the top end of the cylindrical tank and the second piston, the cylindrical tank further having a fourth pipe connected between the variable closed air chamber and the interior of the tubular member;

a second closed tank containing an antiseptic solution, the second closed tank having a hole formed at a top thereof and a drawing pipe which has an upper end protruding out from the top of the second closed tank and a lower end extending adjacent to a bottom of the second closed tank; and a connecting pipe disposed over the first and second closed tanks and the cylindrical tank, the connecting pipe interconnecting the central opening of the cylindrical tank and the upper end of drawing pipe of the second closed tank, the connecting pipe having a branch pipe with a free end connected to the first closed tank, the free end of the branch pipe having an elastic rubber nipple member with an outlet connected thereto, the connecting pipe having a check valve assembly, the check valve assembly being actuated to open in order to permit the antiseptic solution to flow from the second closed tank into the connecting pipe when the first piston member is moved downward so as to produce a suction force in the tube member, the connecting pipe and the tube member of the cylindrical tank that is filled with the antiseptic solution, the antiseptic solution in the connecting pipe being squeezed into the first closed tank through the outlet of the elastic rubber nipple member when the first piston member is forced upward against the biasing force of the coil spring.

Other features and advantages of this invention will become apparent in the following detailed description of the preferred embodiment of this invention with reference to the accompanying drawings.

DETAILED DESCRIPTION OF THE PREFERRED EMBODIMENT

Figure 1:
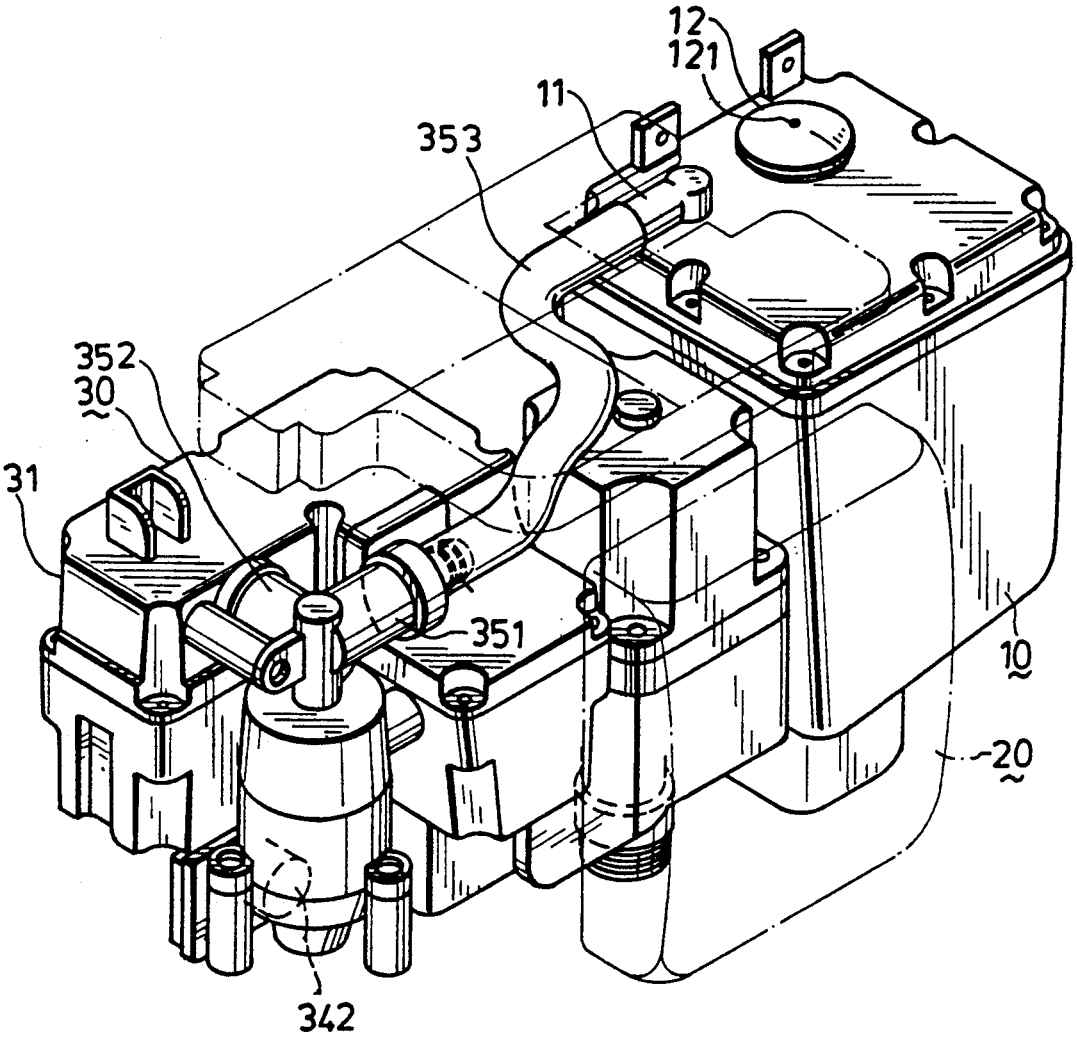
FIG. 1 is a perspective view of a preferred embodiment of the automatic flushing apparatus for urinals of this invention.

Referring to the drawings, the automatic flushing apparatus for urinals of this invention includes a second closed tank 10, an electrical controlling apparatus 20, a first closed tank 31, an upright cylindrical tank 34, and a housing 40 fixed on the top of a urinal.

Figure 2:
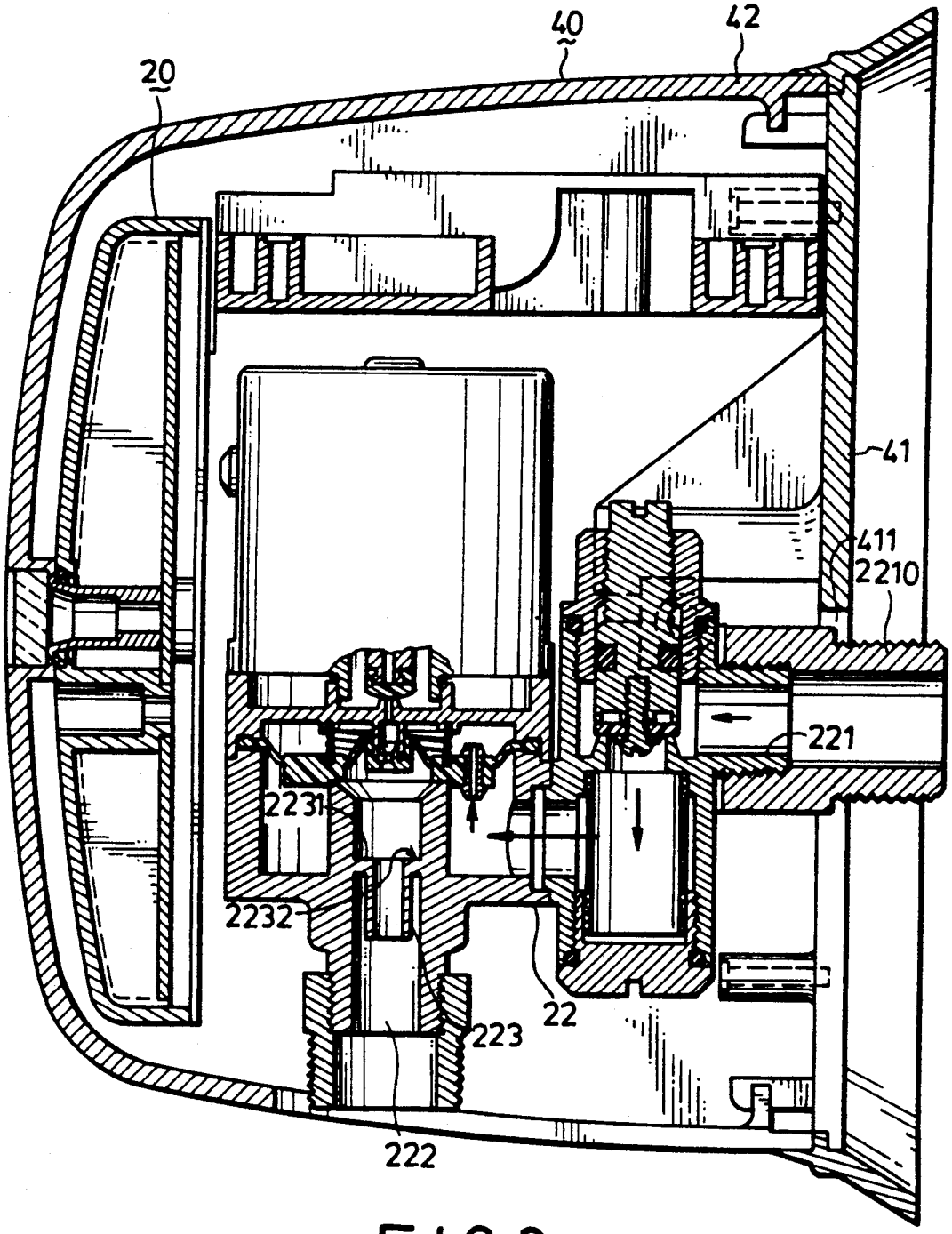
FIG. 2 is a partial sectional side view illustrating the electrically controlling apparatus and the electromagnetic valve of the automatic flushing apparatus for urinals of this invention.
Figure 3:
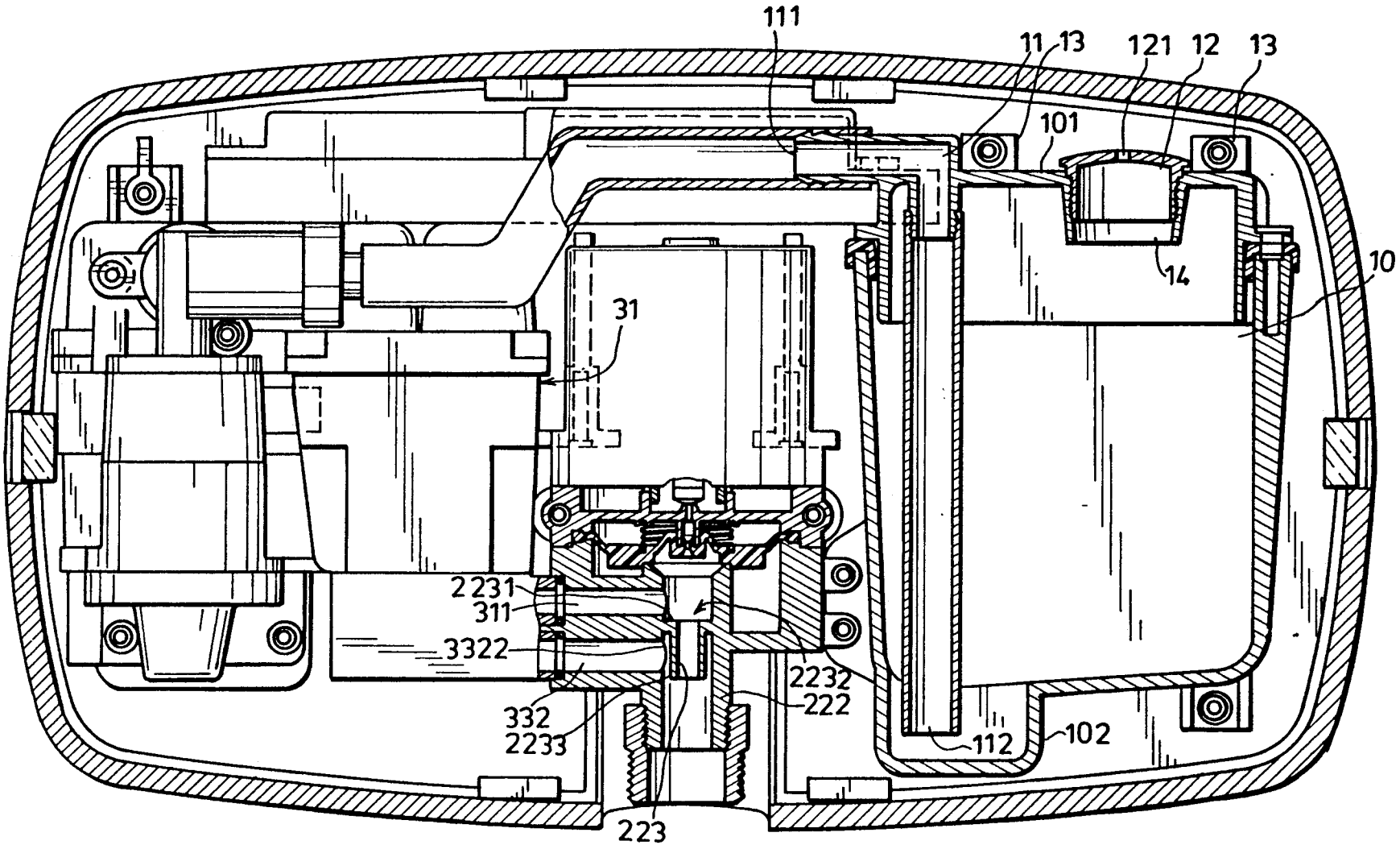
FIG. 3 is a partial sectional front view of the electromagnetic valve of the automatic flushing apparatus for urinals of this invention.

Referring to FIGS. 1, 2 and 3, the electrical controlling apparatus 20 is mounted on the housing 40 and includes an electromagnetic valve 22 fixed in the housing 40. The electromagnetic valve 22 has an inlet tube 221 connected to a water pipe (2210) and an outlet tube 222 connected to the urinal. The outlet tube 222 has an inner tube 223 coaxially mounted therein. The inner tube 223 has an upper end which has an outwardly extending radial flange 2231 connected to an internal wall of the outlet tube 222, thereby defining a shoulder 2232 in the outlet tube 222.

The electrical controlling apparatus 20 further includes a control means (not shown) for opening and closing the electromagnetic valve 22, a photoelectric emitting means (not shown) for generating a light beam therefrom, and a photoelectric sensing means (not shown) in connection with the control means and the photoelectric emitting means for automatically effecting water flushing operation as in the prior art. The control means, the photoelectric emitting means and the photoelectric sensing means are constructed and arranged in the electrical controlling apparatus 20 as in a known manner, which is not the feature of this invention and will not be described here for simplification.

Figure 4:
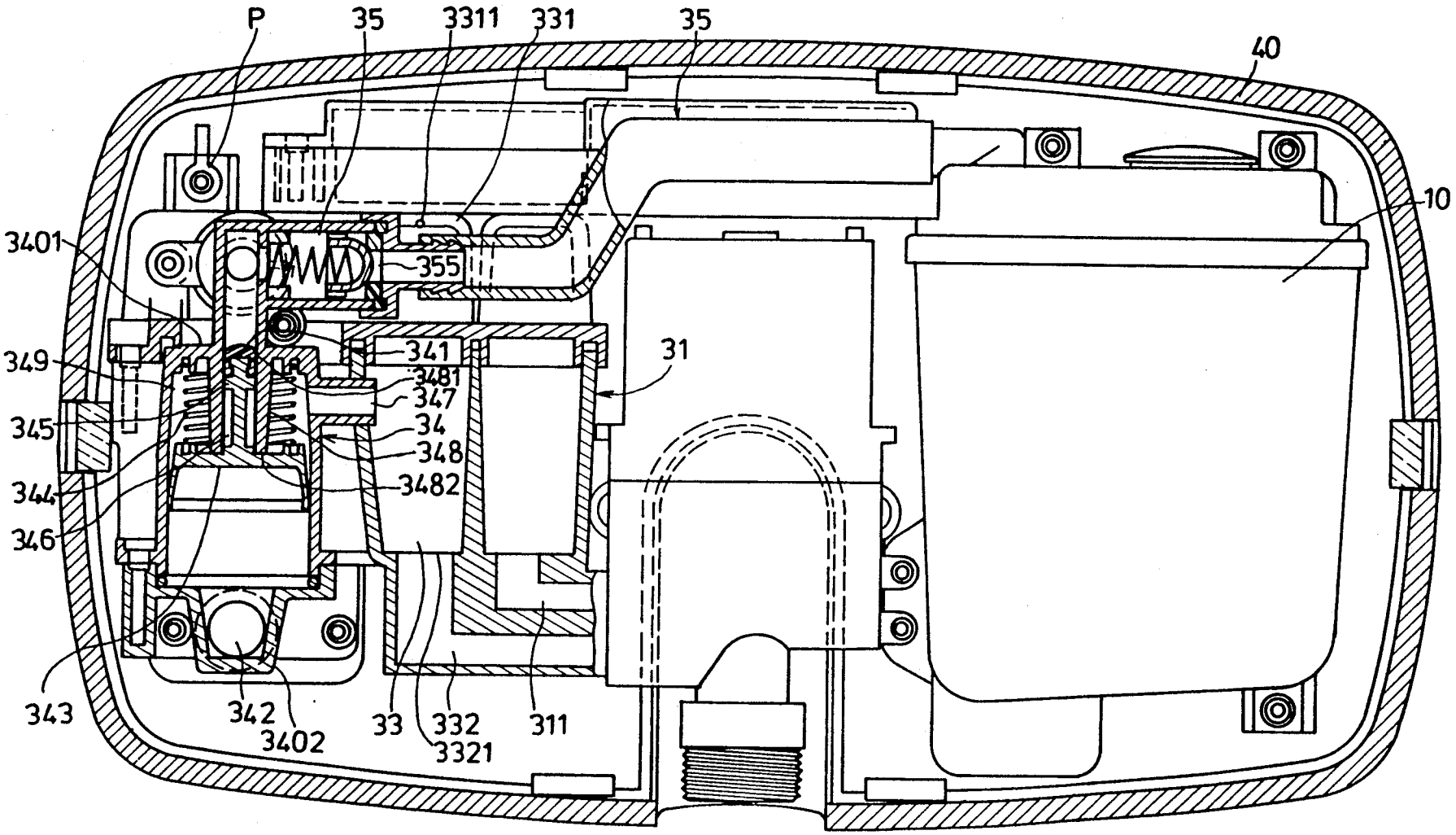
FIG. 4 is a partial sectional front view of the cylindrical tank of the automatic flushing apparatus for urinals of this invention.
Figure 5:
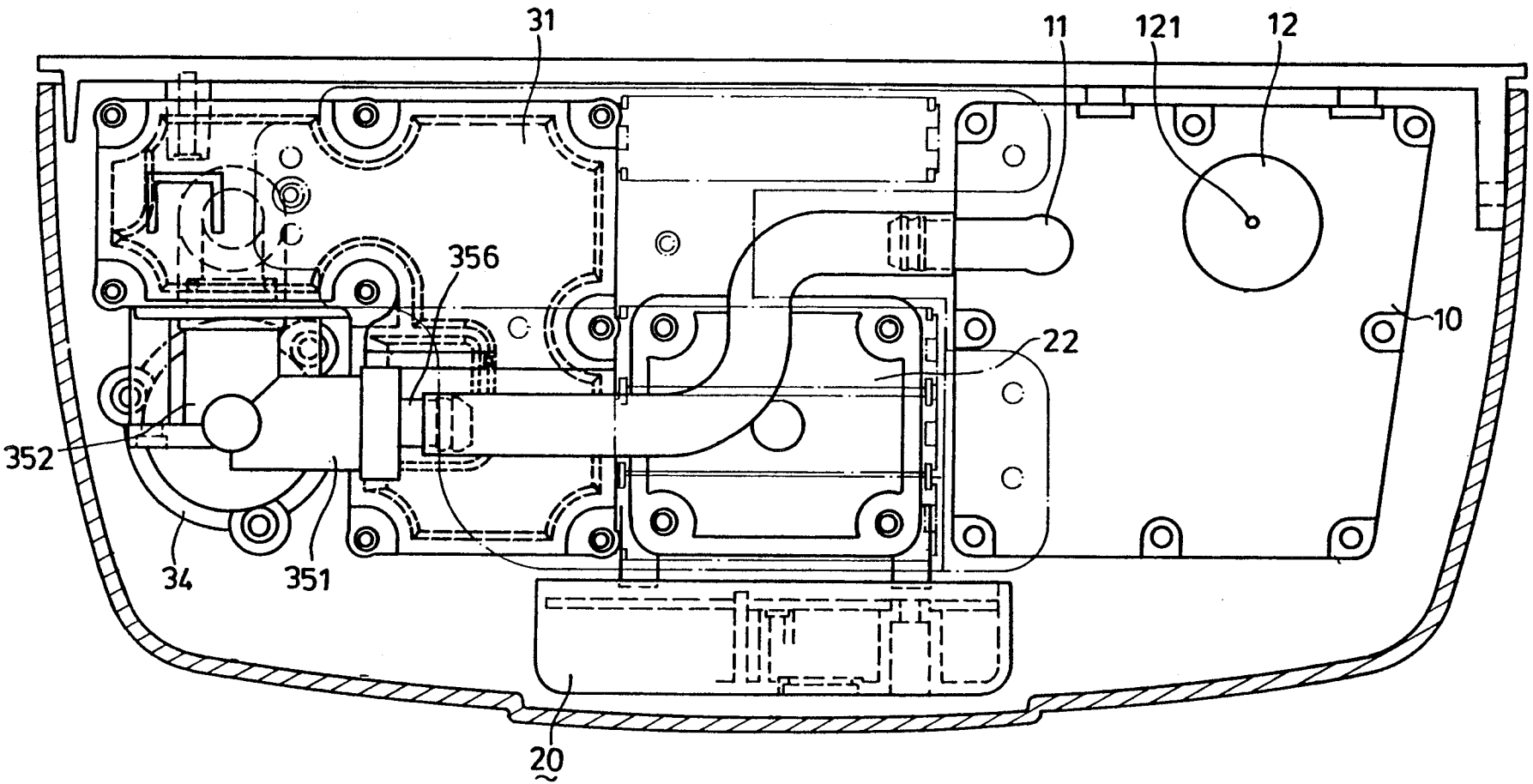
FIG. 5 is a top view of the automatic flushing apparatus for urinals of this invention.

Referring to FIGS. 1, 3, 4 and 5, the first closed tank 31 is L-shaped in cross section. The top of the first closed tank 31 has a tab with a threaded hole (P) in order to fix the first closed tank 31 to the housing 40. The bottom of the first closed tank 31 has a first pipe 311 connected to the outlet tube 222 of the electromagnetic valve 22 above the shoulder 2232 of the outlet tube 222, so that a part of flushing water can flow into and fill the first closed tank 31 during the water flushing operation. A second pipe 332 has an upper end 3321 connected to the bottom of the first closed tank 31, as shown in FIG. 4, and a lower end 3322 connected to the outlet tube 222 of the electromagnetic valve 22. The lower end 3322 of the second pipe 332 faces the external wall 2233 of the inner tube 223 below the shoulder 2232 so as to prevent the flushing water from entering the second pipe 332, as best illustrated in FIG. 3. A tubular member 33 is disposed in the first closed tank 31 and has an open lower end connected to the upper end 3321 of the second pipe 332 and a closed upper end 331 extending near the top of the first closed tank 31. The closed upper end of the tubular member 33 has a vent hole 3311 formed thereon.

The upright cylindrical tank 34 has a closed top end 3401 and a closed bottom end 3402 and is fixed in the housing 40 beside the first closed tank 31. The bottom end 3402 has a third pipe 342 connected to the bottom of the first closed tank 31. The top end 3401 of the cylindrical tank 34 has a central opening 341 formed therein. A tube member 348 coaxially depends from the top end of the cylindrical tank 34. The tube member 348 has an upper open end 3481 connected to the central opening 341 and a lower open end 3482 extending to the intermediate portion of the cylindrical tank 34. A first piston member 345 is slidably received in the tube member 348 and a second piston member 343 is slidably received in the lower portion of the cylindrical tank 34. A connecting rod 346 interconnects the first and second piston members 346 and 343. A coil spring 344 sleeves around the tube member 348 and is disposed between the top end 3401 of the cylindrical tank 34 and the second piston 343 so as to urge the second piston member 343 toward the bottom end 3402 of the cylindrical tank 34. A variable closed air chamber 349 is confined between the top end 3401 of the cylindrical tank 34 and the second piston 343. The cylindrical tank 34 further has a fourth pipe 347 interconnecting the variable closed air chamber 349 and the interior of the tubular member 33.

The second closed tank 10 contains an antiseptic solution therein. The second closed tank 10 has a hole 14 formed at a top 101 thereof and a drawing pipe 11 which has an upper end 111 protruding out from the top 101 of the second closed tank 10 and a lower end 112 extending adjacent to a bottom 102 of the second closed tank 10. A cover 1 with a vent hole 121 is detachably mounted in the hole 12 of the second closed tank 10. Therefore, the antiseptic solution can be added to the second closed tank 10 through the hole 14 as the antiseptic is used up.

Figure 6:
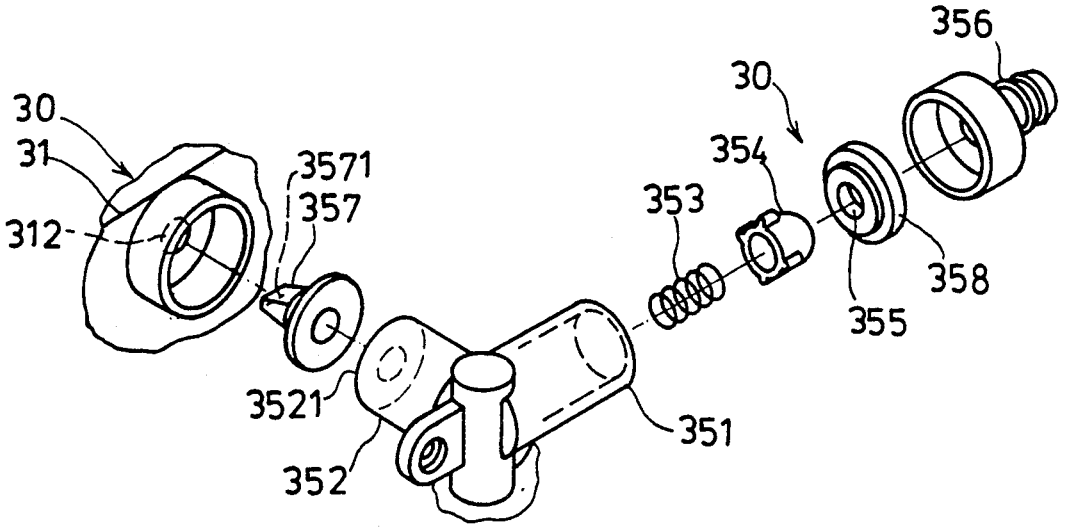
FIG. 6 is a fragmentary perspective exploded view of the connecting pipe of the automatic flushing apparatus for urinals of this invention.

Referring to FIGS. 1, 3, 4, and 5, a connecting pipe 35 is disposed over the first and second closed tanks 31 and 10 and the cylindrical tank 34. The connecting pipe 35 includes an L-shaped portion 351 having a first end connected to the central opening 341 of the cylindrical tank 34 and a second end connected to the upper end 111 of drawing pipe 11 of the second closed tank 10 via a flexible tube 353. The connecting pipe 35 further has a branch pipe 352 with a free end 3521 connected to the L-shaped portion 351 thereof. The free end 3521 of the branch pipe 352 has an elastic rubber nipple member 357 with a slit-form outlet 3571 which is connected to an opening 312 formed in the first closed tank 31, as best illustrated in FIG. 6. The slit-form outlet allows the antiseptic solution in the connecting pipe 35 to be squeezed into the first closed tank 31 through the opening 312 when the liquid pressure of the antiseptic solution in the connecting pipe 35 is increased. The L-shaped portion 351 of the connecting pipe has a check valve assembly 30. The check valve assembly 30 is actuated to open in order to permit the antiseptic solution to flow from the second closed tank 10 into the connecting pipe 35 when the first piston member 345 is moved downward so as to produce a suction force in the tube member 348. The check valve assembly includes a valve seat 356 having an engaging ring member 358 with a central hole 355 connected to the second end of the L-shaped portion 351 of the connecting pipe 35, a stop head 354 and a spring member 353 biasing the stop head 354 to close the central hole 355 of the engaging ring member 358 of the valve seat 356.

Figure 8:
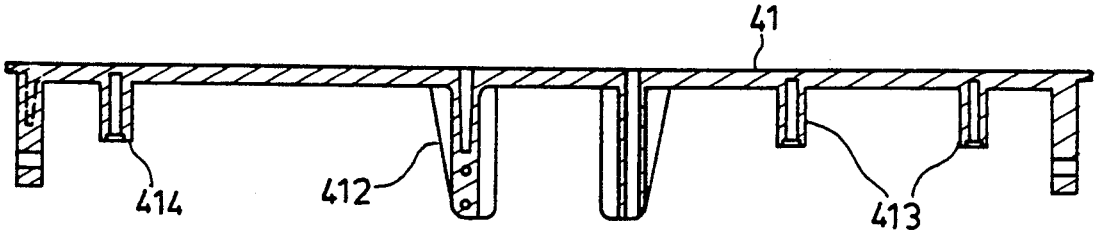
FIG. 8 is a top view of the mounting plate of the housing of the automatic flushing apparatus for urinals of this invention.
Figure 7:
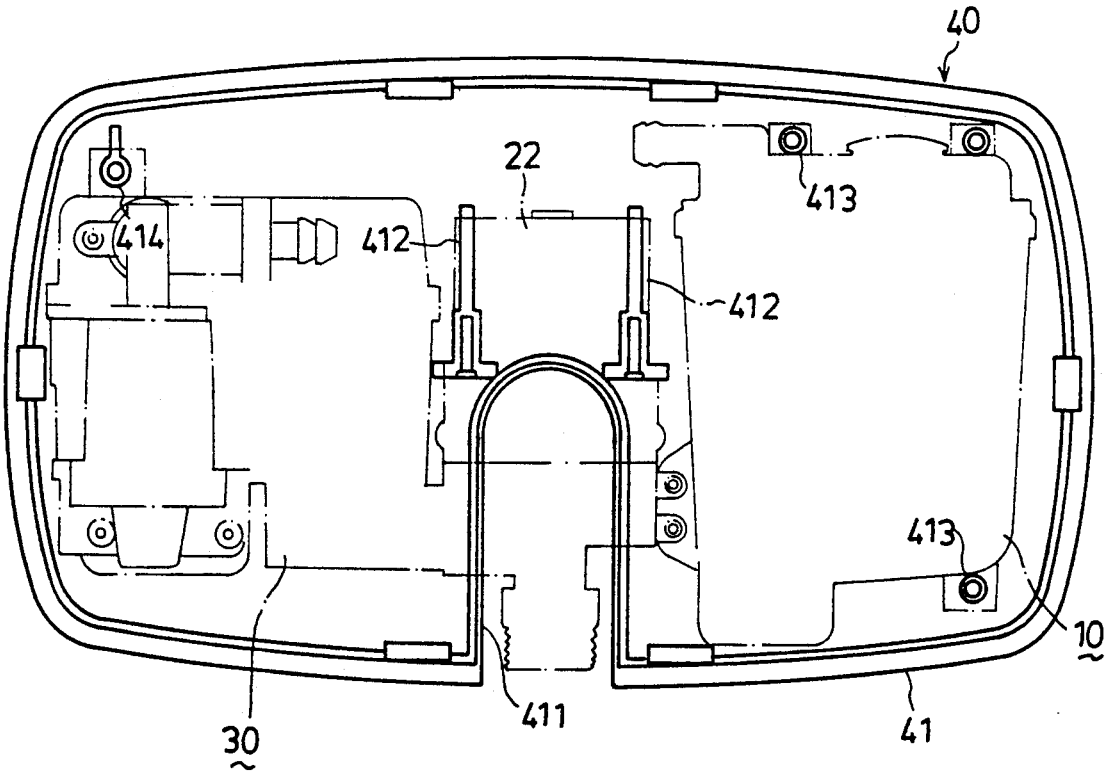
FIG. 7 is a front view of the housing of the automatic flushing apparatus for urinals of this invention.

Referring to FIGS. 2, 7, and 8, the housing 40 includes a wall mounting plate 41 and a front casing 42. A fixing hole 411 is provided in the wall mounting plate 41 through which the water pipe 2210 is passed. The wall mounting plate 41 has a fixing plate 412 and fixing threaded holes 413 and 414 in order to fix the electromagnetic valve 22, the upright cylindrical tank 34, the first and second closed tanks 31, 10 thereto. The front casing 42 is screwed to the wall mounting plate 41 so as to enclose all the parts of the automatic flushing apparatus of this invention therein.

In use, when the electrical controlling apparatus is actuated, the electromagnetic valve 22 allows water to flow from the inlet tube 221 to the outlet tube 222 for a predetermined period of time. A part of the flushing water will flow into and fill the first closed tank 31 through the first pipe 311 due to the stop effect of the shoulder 2232 in the outlet tube 222 during the automatic flushing operation as described hereinbefore. Meanwhile, air in the first closed tank 31 is expelled out from the vent hole 3311 of the tubular member 33. The water in the first closed tank 31 flows to the closed bottom end 3402 of the cylindrical tank 34 through the third pipe 342, thereby pushing the second piston member 343 to move upward against the biasing force of the coil spring 344. The first piston member 345 is thus moved upward, thereby increasing the liquid pressure of the antiseptic solution in the connecting tube 35. Meanwhile, air in the variable closed air chamber 349 will be expelled out from the fourth pipe 347 into the tubular member 33 which is connected to the outlet tube 222. Therefore, the antiseptic solution in the connecting tube 35 can be squeezed into the first closed tank 31 through the slit-form outlet 3571 of the elastic rubber nipple member 357. The antiseptic solution dropped into the first closed tank 31 is mixed with the water in the first closed tank 31.

After the above-mentioned flushing operation is completed, the flushing water from the water pipe 2210 is stopped by the electromagnetic valve 22. The water mixed with the antiseptic solution in the first closed tank 31 begins to flow out therefrom through the first pipe 311 into the outlet tube 222 of the electromagnetic valve 22 so as to flush the urinal for sterilizing purposes. During this process, the second piston member 343 is gradually pushed downward by the coil spring 344 when water flows out of the first closed tank 31. The first piston member 345 is thereby moved downward, producing a suction force in the connecting pipe 35. This suction force moves the stop head 354 against the biasing force of the spring member 353 in order to disengage the central hole 355 of the engaging ring member 358 and allow the antiseptic solution in the second closed tank 10 to flow into the connecting pipe 35 through the drawing pipe 11. After a predetermined amount of antiseptic solution flows into the connecting pipe 35, the suction force will be gradually decreased to zero. Therefore, the stop head 354 will be pushed to close the central hole 355 by means of the biasing force of the spring member 353.

It is noted that the sterilizing flushing operation of the automatic flushing apparatus of this invention is accomplished by mechanical power rather by electric power as in the prior art. This causes the automatic flushing apparatus to save energy.

With this invention thus explained, it is apparent that numerous modifications and variations can be made without departing from the scope and spirit of this invention. It is therefore intended that this invention be limited only as indicated in the appended claims.

I claim:

1. An automatic flushing apparatus for a urinal comprising:

a housing adapted to be fixed on the top of said urinal;

an electromagnetic valve fixed in said housing, said electromagnetic valve having an inlet tube adapted to be connected to a water pipe and an outlet tube adapted to be connected to said urinal, said outlet tube having an inner tube coaxially mounted therein, said inner tube having an upper end which has an outwardly extending radial flange connected to an internal wall of said outlet tube, thereby defining a shoulder in said outlet tube;

a control means for opening and closing said electromagnetic valve;

a photoelectric emitting means for generating a light beam therefrom;

a photoelectric sensing means in connection with said control means and said photoelectric emitting means for automatically effecting water flushing operation;

a first closed tank having a top and a bottom, said bottom of said first closed tank having a first pipe connected to said outlet tube of said electromagnetic valve above said shoulder of said outlet tuve, so that part of the flushing water can flow into and fill said first closed tank during the water flushing operation, and a second pipe having an upper end connected to said bottom of said first closed tank and a lower end connected to said outlet tube of said electromagnetic valve, said lower end of said second pipe facing an external wall of said inner tube below said shoulder so as to prevent the flushing water from entering said second pipe;

a tubular member disposed in said first closed tank and having an open lower end connected to said upper end of said second pipe and a closed upper end extending near said top of said first closed tank, said closed upper end of said tubular member having a vent hole formed therein;

an upright cylindrical tank having a closed top and bottom end and being fixed in said housing beside said first closed tank, said bottom end having a third pipe connected to said bottom of said first closed tank, said top end of said cylindrical tank having a central opening formed therein and a tube member coaxially depending therefrom, said tube member having an upper open end connected to said central opening and a lower open end extending to an intermediate portion of said cylindrical tank, a first piston member being slidably received in said tube member and a second piston member being slidably received in a lower portion of said cylindrical tank, a connecting rod interconnecting said first and second piston members, a coil spring sleeved around said tube member and disposed between said top end of said cylindrical tank and said second piston member so as to urge said second piston member toward said bottom end of said cylindrical tank, a variable closed air chamber being confined between said top end of said cylindrical tank and said second piston, said cylindrical tank further having a fourth pipe interconnecting said variable closed air chamber and the interior of said tubular member;

a second closed tank containing an antiseptic solution, said second closed tank having a hole formed at a top thereof and a drawing pipe which has an upper end protruding out from said top of said second closed tank and a lower end extending adjacent to a bottom of said second closed tank; and a connecting pipe disposed over said first and second closed tanks and said cylindrical tank, said connecting pipe interconnecting said central opening of said cylindrical tank and said upper end of said drawing pipe of said second closed tank, said connecting pipe having a branch pipe with a free end connected to said first closed tank, said free end of said branch pipe having an elastic rubber nipple member with an outlet connected thereto, said connecting pipe having a check valve assembly, said check valve assembly being actuated to open in order to permit the antiseptic solution to flow from said second closed tank into said connecting pipe when said first piston member is moved downward so as to produce a suction force in said tube member, said connecting pipe and said tube member of said cylindrical tank being filled with the antiseptic solution, said antiseptic solution in said connecting pipe being squeezed into said first closed tank through said outlet of said elastic rubber nipple member when said first piston member is forced upward against the biasing force of said coil spring.

2. An automatic flushing apparatus for a urinal as claimed in claim 1, wherein said check valve assembly includes a valve seat with a central hole fixed in said connecting pipe, a stop head and a spring member biasing said stop head to close said central hole of said valve seat.

* * * * *

UNITED STATES PATENT AND TRADEMARK OFFICE

CERTIFICATE OF CORRECTION

PATENT NO. : 5,269,028

DATED : Dec. 14, 1993

INVENTOR(S) : Su-Lan Liao

It is certified that error appears in the above-indentified patent and that said Letters Patent is hereby corrected as shown below:

Column 6, line 28, delete "tuve", and insert --tube--.

Signed and Sealed this

Fifth Day of July, 1994

Bruce Lehman

*Attest:*

BRUCE LEHMAN

*Attesting Officer*

*Commissioner of Patents and Trademarks*